US009132464B2

(12) United States Patent
Takacs et al.

(10) Patent No.: US 9,132,464 B2
(45) Date of Patent: Sep. 15, 2015

(54) METHOD FOR HOT STAMPING METAL

(75) Inventors: Arpad Takacs, Thornhill (CA); Di Yang, Troy, MI (US); Roger Bianchi, Macomb, MI (US)

(73) Assignee: Martinrea Industries, Inc., Troy, MI (US)

( * ) Notice: Subject to any disclaimer, the term of this patent is extended or adjusted under 35 U.S.C. 154(b) by 264 days.

(21) Appl. No.: 13/494,307

(22) Filed: Jun. 12, 2012

(65) Prior Publication Data

US 2013/0327453 A1 Dec. 12, 2013

(51) Int. Cl.

| | |
|---|---|
| ***C21D 8/00*** | (2006.01) |
| ***B21D 28/26*** | (2006.01) |
| ***C21D 1/673*** | (2006.01) |
| ***B21D 22/02*** | (2006.01) |
| ***B21D 35/00*** | (2006.01) |
| *C21D 1/773* | (2006.01) |
| *C21D 1/613* | (2006.01) |

(52) U.S. Cl.

CPC ..... *B21D 28/26* (2013.01); *B21D 22/022* (2013.01); *B21D 35/001* (2013.01); *C21D 1/673* (2013.01)

(58) Field of Classification Search

CPC ..... C21D 8/00; C21D 8/0205; C21D 1/673; C21D 2211/008

USPC ..... 148/654, 628, 633

See application file for complete search history.

(56) References Cited

U.S. PATENT DOCUMENTS

| | | | | |
|---|---|---|---|---|
| 5,351,664 | A | 10/1994 | Rotter et al. | |
| 6,021,562 | A * | 2/2000 | Boster et al. | 29/798 |
| 7,261,080 | B2 | 8/2007 | Chonan et al. | |
| 8,261,591 | B2 | 9/2012 | Hielscher | |
| 2009/0155615 | A1 * | 6/2009 | Chen et al. | 428/593 |
| 2009/0211669 | A1 * | 8/2009 | Vehof | 148/654 |
| 2012/0180910 | A1 * | 7/2012 | Thomas et al. | 148/531 |

OTHER PUBLICATIONS

Karbasian et al, A Review on Hot Stamping, Journal of Materials Processing Technology 210 (2010) pp. 2103-2118.

Billur et al., Exploring the 3rd International Conference on Hot Stamping Technology, Part 1. Nov./Dec. 2011, www.stampingjournal.com.

Prior Art Material to Patentability in U.S. Appl. No. 13/494,307.

* cited by examiner

*Primary Examiner* — Kaj K Olsen
*Assistant Examiner* — Alexander Polyansky
(74) *Attorney, Agent, or Firm* — Gifford, Krass, Sprinkle, Anderson & Citkowski, P.C.

(57) ABSTRACT

A method for hot stamping an iron based component in which the component is heated to a temperature sufficient to transform the component into austenite. The heated component is then positioned in an open stamping die and the stamping die is closed to mechanically change the shape of the heated component to a desired end shape of the component. At least one opening is punched in the heated component and, thereafter, the component is quenched at a rate and to a temperature sufficient to transform the component into martensite.

10 Claims, 2 Drawing Sheets

METHOD FOR HOT STAMPING METAL

BACKGROUND OF THE INVENTION

I. Field of the Invention

The present invention relates generally to metal treating methods and, more particularly, to a method for hot stamping iron based components.

II. Description of the Prior Art

There are many industrial applications in which a very hard component is required. For example, in automotive vehicles, the components such as the vertical pillars for the automotive vehicle are typically constructed of very hard materials to protect the occupants of the vehicle in the event of a crash.

One common hard material used in automotive applications is martensite, an allotrope of carbon steel. In order to form the martensite component, the sheet stock of carbon based steel is first heated to a temperature necessary to transform the sheet stock to austenite. Thereafter, the heated sheet stock is positioned within a stamping die and the die is closed to mechanically transform the bar stock to the desired end shape for the component. The now formed component is then quenched at a rate sufficient to transform the austenite to martensite while in the die. After quenching, the component is removed.

The component now transformed into martensite exhibits superior hardness and stiffness sufficient for the component to be used in applications where the hardness and stiffness is desired.

One difficulty, however, of martensite components is that it is difficult to perform post hot stamp operations such as trimming and piercing or the attachment of fastening nuts in such components. For example, conventional tool steel punches that are normally used to punch holes in steel components are inadequate for punching openings in martensite components.

Consequently, in order to form openings or attach fastening nuts within the martensite components, it has been previously necessary to utilize other methods, such as laser cutting, to trim and pierce the openings in the component. These alternative methods, however, are expensive compared to conventional punching methods, and thus increase the overall manufacturing cost of the component.

There have, however, been attempts to punch the required openings or attach a fastening nut in the component prior to transforming the component into martensite. However, due to the thermal expansion of the component while heating the component to a temperature sufficient to transform the steel to austenite, such "prepunching" of the openings in the component makes it difficult, if not altogether impossible, to accurately locate and size the openings in the component to the tolerances required by the automotive industry as well as other industries. Also this causes residual tensile stress which can lead to a potential delay fracture.

SUMMARY OF THE PRESENT INVENTION

The present invention provides a method for hot stamping an iron based component which overcomes the above mentioned disadvantages of the previously known methods.

In brief, in the method of the present invention, the material, typically carbon steel sheet stock, to form the component is first heated to a temperature sufficient to transform the component material into austenite. The transformation to austenite begins at about 750° centigrade and the transformation is completed at about 850° centigrade at a heating speed of 5° centigrade per second.

The material, while still heated, is then positioned in an open stamping die having a stamping cavity in the shape of the desired component. The die is then closed to change the component material into the desired end shape for the component.

While the material is still heated, and prior to quenching, one or more openings are punched in the heated material. Since the heated material is still in its austenite phase prior to quenching, punches constructed of conventional material for punches may be used to trim and pierce the openings.

Following the punching operation, the heated component is quenched at a rate and to a temperature sufficient to transform the material into martensite. Preferably, such quenching occurs by flowing a cooling liquid, such as water, through cooling channels formed within the die.

After completion of the quench, the component, now transformed to martensite, is removed from the die with its punched opening or openings.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
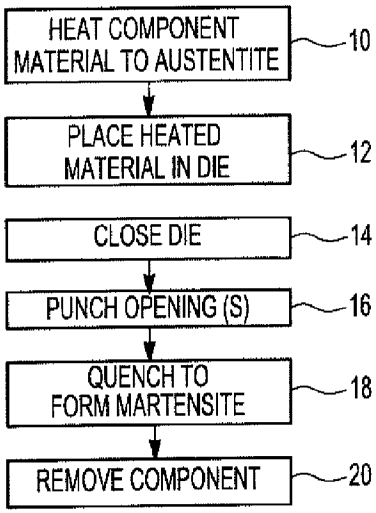
FIG. 1 is a flowchart illustrating the method of the present invention.

With reference first to FIG. 1, the material used to form the desired end component is an iron based material, such as carbon steel sheet stock. In order to manufacture the component in accordance with the method of the present invention, the material is first heated at step 10 to a temperature and at a temperature rate sufficient to form austenite. Ferrite, i.e. the iron based material, transforms to austenite beginning at about 750° centigrade and the transformation to austenite is complete at about 850° centigrade and at a heating speed of about 5° centigrade per second.

Figure 2:
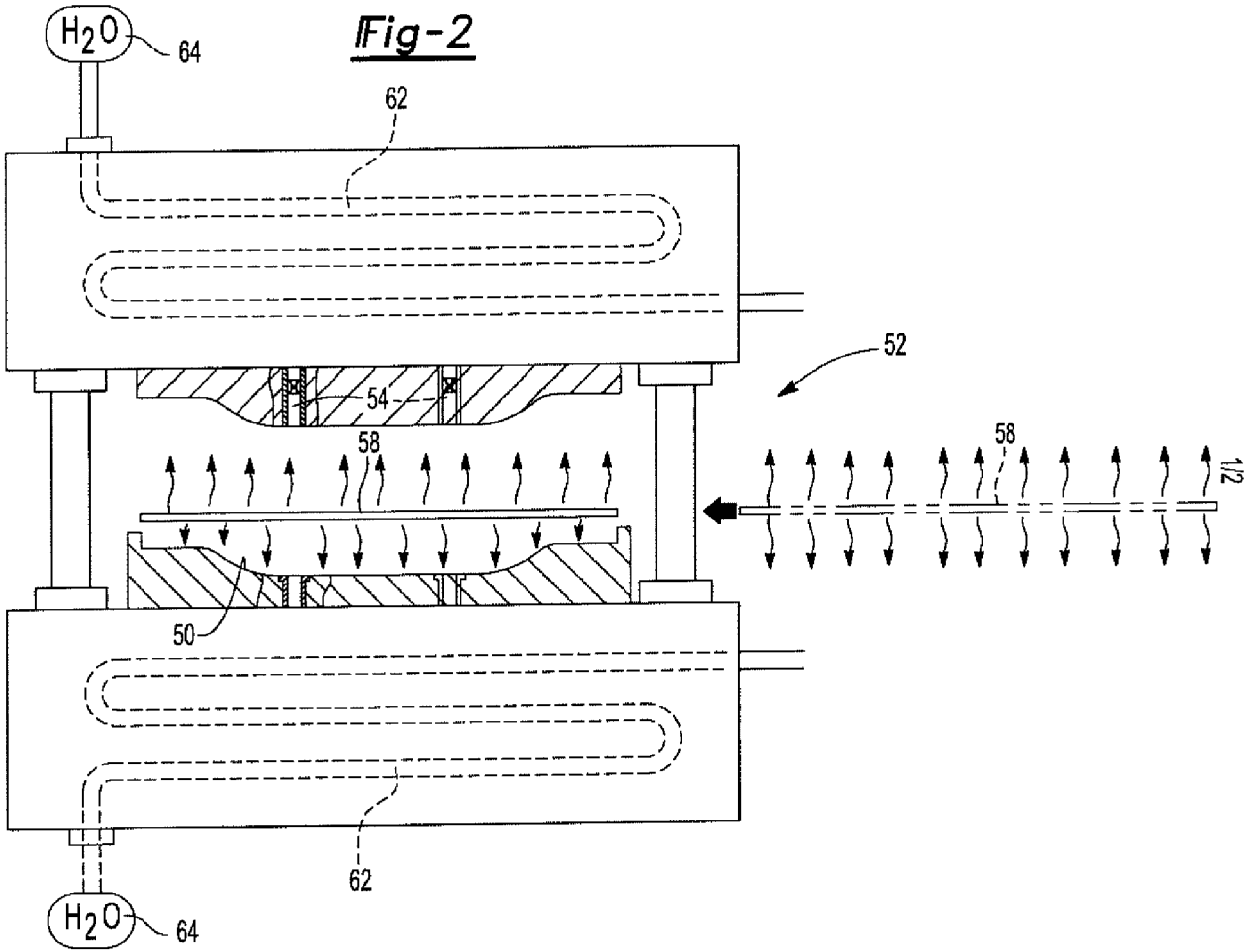
FIG. 2 is a diagrammatic view of the heated component material positioned within a die.

With reference now to FIGS. 1 and 2, the heated material, while still hot, is placed within the stamping cavity 50 of an open stamping die 52. The shape of the stamping cavity 50 conforms to the shape of the desired end component.

At step 14, the die 52 is closed thus mechanically changing the shape of the heated material to the shape of the desired end component. The force necessary to actually close the die 52 will depend upon the size and shape of the component.

Figure 3:
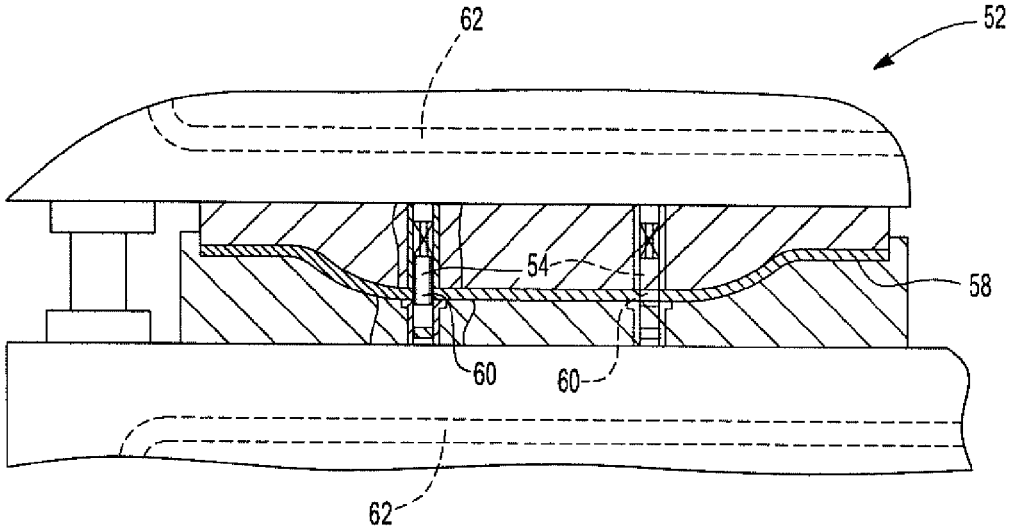
FIG. 3 is a diagrammatic view of the formed component during a punching operation.

With reference now to FIGS. 1 and 3, after closure of the die at step 14, step 14 then proceeds to step 16 in which one or more punches 54 are actuated to punch one or more openings in the component 58. This punching step 16, furthermore, occurs while the component 58 is still heated and thus still in its austenite phase. Consequently, since austenite is relatively soft, the punches 54 may be constructed of conventional punching material, such as hardened steel.

Figure 4:
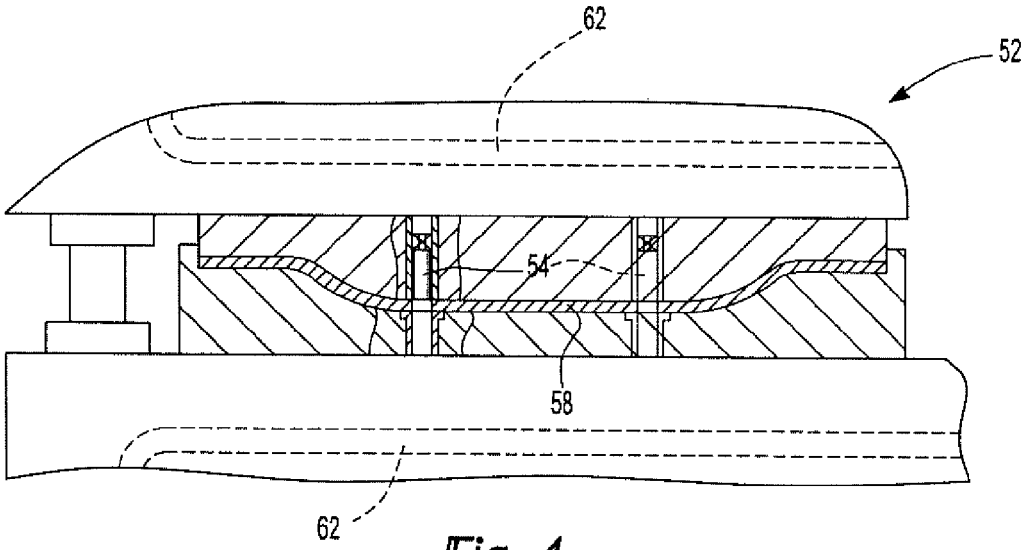
FIG. 4 is a view similar to FIG. 3, but illustrating the quenching operation following the punching operation.

The punches 54 may be operated in any conventional fashion, such as hydraulically. Furthermore, in the conventional fashion, each punch extends through the component 58 during the punching operation as shown at 60. One or more of the punches 54 may remain in its extended position as shown at 60. Step 16 then proceeds to step 18. With reference now to FIGS. 1 and 4, the component 58 is then rapidly quenched to transform the austenite allotrope of the component 58 to martensite. Such transformation is completed at about 350° centigrade and the entire component 58 is totally martensitic.

Fastening nuts of the type that are attached to the component by piercing the component may also be installed in the component by pressing the nut into the component prior to quenching.

Any conventional method may be used to perform the quench to transform the austenite component 58 to martensite. However, in the preferred embodiment of the invention, cooled water from the source 64 is pumped through cooling channels formed within the die 52.

After completion of the transformation of the component to martensite, step 18 proceeds to step 20 where the die 52 is opened and the now formed component 58 removed from the die. In the event that one or more of the punches 54 remains in its extended position, i.e. extending through the component 58, during the quenching step, the punch 54 is first retracted out of the component prior to removal of the component 58 from the die 54.

In practice, by punching the openings within the component after transformation of the component to austenite, but prior to quenching of the component to transform the component to martensite, openings with relatively small dimensional tolerances can be accurately formed in the component without the need for further machining.

From the foregoing, it can be seen that the present invention provides a unique method for manufacturing iron based components having punched openings. Having described our invention, however, many modifications thereto will become apparent to those skilled in the art to which it pertains without deviation from the spirit of the invention as defined by the scope of the appended claims.

We claim:

1. A method for hot stamping an iron based component material comprising the steps of:

heating the component material to a temperature sufficient to transform the component into austenite, thereafter positioning the heated component material into an open stamping die, closing the stamping die to mechanically change the shape of the heated component material to a desired end shape of the component, punching at least one opening in the heated component material while still heated to said temperature sufficient to transform the component into austenite and while the stamping die is closed, and thereafter quenching the heated component material at a rate and to a temperature sufficient to transform at least a portion of the component material into martensite, wherein the punch remains positioned through the component material during at least a portion of said quenching step.

2. The method defined in claim 1 wherein said punching step further comprises the step of punching at least two openings in the heated component.

3. The method defined in claim 1 wherein said punching step is performed after said closing step.

4. The method defined in claim 1 wherein said quenching step transforms substantially all of the component into martensite.

5. The method defined in claim 1 wherein the component is a component for an automotive vehicle.

6. The method defined in claim 1 wherein the component is a carbon steel component.

7. The method defined in claim 1 wherein said punching step is performed by a punch mechanism contained at least partially in the die.

8. The method defined in claim 1 wherein the die includes fluid channels and wherein said quenching step is performed by flowing a cooling liquid through the fluid channels.

9. The method defined in claim 8 wherein the cooling liquid is water.

10. The method defined in claim 1 wherein said punching step includes the step of attaching a fastening nut.

* * * * *